US006096682A

United States Patent [19]

Steenackers et al.

[11] Patent Number: 6,096,682

[45] **Date of Patent: *Aug. 1, 2000**

[54] PROCESS FOR THE PRODUCTION OF A CATALYST BODY FOR THE CATALYTIC TREATMENT OF GAS, CATALYST BODY AND CATALYTIC CONVERTER

[75] Inventors: Pieter Delfina Steenackers, Heverl; Freddy Frans P. Wollants, Aarschot, both of Belgium; Adrianus Johannes F. Hoefnagels, Asten, Netherlands

[73] Assignee: Scambia Industrial Developments AG, Schaan, Liechtenstein

[ * ] Notice: This patent issued on a continued prosecution application filed under 37 CFR 1.53(d), and is subject to the twenty year patent term provisions of 35 U.S.C. 154(a)(2).

[21] Appl. No.: 08/754,669

[22] Filed: Nov. 21, 1996

[30] Foreign Application Priority Data

Nov. 23, 1995 [CH] Switzerland ..... 3311/95

[51] Int. Cl.[7] ..... B01J 23/02; B01D 50/00; C01B 23/00; F01N 3/10

[52] U.S. Cl. ..... 502/439; 502/527; 422/180; 422/181; 423/213.2; 60/299

[58] Field of Search ..... 502/527, 439, 502/151, 105; 422/176, 169, 180, 181; 60/299; 428/593

[56] References Cited

U.S. PATENT DOCUMENTS

| | | | |
|---|---|---|---|
| 3,627,592 | 12/1971 | Schmidt et al. | 148/26 |
| 4,363,676 | 12/1982 | Crockett et al. | 148/24 |
| 4,675,056 | 6/1987 | Melfi et al. | 148/24 |
| 5,187,142 | 2/1993 | Richmond et al. | 502/249 |
| 5,336,472 | 8/1994 | Toyoda et al. | 422/177 |
| 5,484,575 | 1/1996 | Steenackers | 422/176 |
| 5,593,465 | 1/1997 | Steenackers | 422/176 |

FOREIGN PATENT DOCUMENTS

| | | |
|---|---|---|
| 56089836 | 7/1981 | Japan . |
| 6254409 | 9/1994 | Japan . |
| 7116758 | 5/1995 | Japan . |

*Primary Examiner*—Gary P. Straub
*Attorney, Agent, or Firm*—Brown & Wood, LLP

[57] ABSTRACT

For the production of a catalyst body for the catalytic treatment of gas, in particular for the purification of exhaust gas, flat and corrugated sheet metal members having a metallic core and coatings are formed, which coatings comprise a nonmetallic wash coat and at least one catalytically active noble metal. A packet comprising sheet metal members having coatings is then arranged between two walls of a sleeve. Thereafter, each edge of each sheet metal member, which edge faces one of the two walls, is welded to the relevant wall in at least one edge segment. The sheet metal members adjacent to one another then together bound passages for the exhaust gas. This production process makes it possible, even in the case of small cross-sectional dimensions of the passages, to apply uniform coatings to the entire surfaces of the sheet metal members, said surfaces bounding the passages.

30 Claims, 5 Drawing Sheets

PROCESS FOR THE PRODUCTION OF A CATALYST BODY FOR THE CATALYTIC TREATMENT OF GAS, CATALYST BODY AND CATALYTIC CONVERTER

BACKGROUND OF THE INVENTION

1. Field of the Invention

The invention relates to a process for the production of a catalyst body for the catalytic treatment of gas, in particular for the catalytic purification of exhaust gas from an internal combustion engine. Such catalyst bodies intended for incorporation into a housing of a catalytic converter are frequently also referred to as substrates. The internal combustion engine may, for example, belong to an automobile or other motor vehicle or may be stationary.

2. Description of the Prior Art

A catalytic converter disclosed in U.S. Pat. No. 5,187,142 has a catalyst body with rectangular corrugated sheet metal members which are stacked one on top of the other and each of which has waves arranged in a herringbone pattern. Between successive groups of such corrugated sheet metal members are arranged retainer sheet metal members, each of which has a rectangular, corrugated main segment and, at two edges of this which face away from one another, an angled flap. In the production of such a catalyst body, untreated corrugated sheet metal members and retainer sheet metal members are first produced and are stacked one on top of the other. Thereafter, the sheet metal members are connected to one another at their points of contact by brazing or discharge welding and the overlapping flaps are welded to one another and possibly also to the corrugated sheet metal members to form a packet of sheet metal members firmly connected to one another, the flaps together forming inner and outer surfaces with steps. Coatings containing catalytically active material are then applied to the one or more connected sheet metal members. The sheet metal members then together bound passages for the exhaust gas.

In this production process, the production and assembly of the sheet metal members requires a relatively large number of operations. Furthermore, it is difficult and expensive to apply more or less uniform coatings to the entire surfaces of the corrugated sheet metal members and of the main segments of the retainer sheet metal members after assembly of a packet of sheet metal members. In order for the stated surfaces to be more or less completely covered by coatings, the corrugations must be made relatively high. In addition, the corrugations of adjacent sheet metal members must intersect one another so that each pair of adjacent sheet metal members bounds only a single passage which is divided only at the points of contact of the sheet metal members. The catalyst body therefore has only a small number of passages per unit cross-sectional area in a cross-section transverse to the general direction of flow of the exhaust gas, those sections of the surfaces of a passage which are opposite one another generally being large distances apart. For these reasons, the catalyst body produces only a small purification effect per unit volume of the catalyst body and must therefore be relatively large to permit sufficient exhaust gas purification. The known catalyst body and a catalytic converter equipped with such a catalyst body therefore have the disadvantages that they require a large amount of space and are correspondingly heavy. Furthermore, during a cold start, the large mass of the known catalyst body increases the time required for the catalyst body to heat up to a temperature advantageous for effective exhaust gas purification. In addition, the catalyst bodies contain expensive materials, in particular usually at least one noble metal present in the coatings, so that the large mass of a known catalyst body also increases the production costs of the catalytic converter.

In a process disclosed in Japanese Patent Application 6,254,409 for the production of a catalyst body, flat and corrugated sheet metal members are inserted into two sleeves and fastened therein. The two sleeves are then welded to one another. Coatings containing a catalytically active material are then applied to the sheet metal members. The corrugations of the corrugated sheet metal members of catalyst bodies produced in this manner must likewise have large wave heights to enable coatings to be applied to the sheet metal members after the latter have been assembled. The production process disclosed in Japanese Patent Application 6,254,409 and the catalyst body produced by said process therefore have disadvantages which are substantially similar to those of the production process and the catalyst body according to U.S. Pat. No. 5,187,142.

European Patent Applications 0,676,534 and 0,676,535 which corresponds to U.S. Pat. Nos. 5,645,803 and 5,593,645 respectively, disclose catalyst bodies, each of which has rectangular, flat and corrugated sheet metal members and spacer members arranged at two edges of the sheet metal members, which edges face away from one another. For the production of such a catalyst body, sheet metal members are produced according to European Patent Application 0,676,534 and have a corrugated main segment provided with coatings and flat, untreated edge segments, to which spacer members are provisionally fastened by spot welding. Furthermore, flat sheet metal members with a main section having coatings and untreated edge segments are produced. Thereafter, the sheet metal members are stacked one on top of the other and are welded along their stated edges to the spacer members and to one another. However, this production process is rather expensive.

In produced catalytic converters of this type, the lengths of the catalyst body and sheet metal members are at least 100 mm and the widths of the spacer members are about 5 mm. The spacer members and the untreated edge segments of the sheet metal members, which segments are covered by said spacer members, have a relatively large mass which, during a cold start, increases the time required for the catalyst body to heat up to the optimal operating temperature. Continuous tests with catalytic converters of the type described have moreover shown that, under high stresses, in particular in the case of relatively long catalyst bodies, the result may be permanent deformations of sheet metal members, which impair the action of the catalyst body.

SUMMARY OF THE INVENTION

It is the object of the invention to provide a process for the production of a catalyst body, which makes it possible to avoid disadvantages of the known production processes and of the catalyst bodies produced thereby. Starting from the process disclosed in U.S. Pat. No. 5,187,142, it should in particular be possible to apply more or less uniform coatings in a simple manner to the entire surfaces of the sheet metal members which border the passages, even when the passages are provided with small cross-sectional dimensions. Furthermore, the catalyst body should be capable of being produced in an economical manner and should be durable.

This object is achieved by a process for the production of a catalyst body for the catalytic treatment of gas, in particular of exhaust gas from an internal combustion engine, the catalyst body having at least one packet of sheet metal members together bounding passages for the gas, wherein sheet metal members with coatings containing catalytically active material and with two edges facing away from one another are produced, wherein the sheet metal members having coatings and intended for forming a packet are arranged between two walls and each of the two edges of each sheet metal member faces one of the two walls and wherein the sheet metal members having coatings are firmly connected to the two walls by fusion of metallic material at at least one edge segment of each of the two said edges of said sheet metal members.

According to another object of the invention, there is provided a catalyst body for the catalytic treatment of gas, in particular for the catalytic purification of exhaust gas from an internal combustion engine, having at least one packet of sheet metal members which together bound passages for the gas and are arranged between two walls and each of which has coating containing catalytically active material and two edges facing away from one another, wherein said edges of each sheet metal member face one of the walls and each sheet metal member is firmly connected to the two walls by a bond formed by fusion of metallic material at at least one edge segment of each of the two said edges, this bond being produced after application of coatings.

According to a further object of the invention, there is provided a catalytic converter having at least two catalyst bodies, wherein a housing having a wall, an inlet and an outlet is present, the catalyst bodies are arranged in the housing, the inlet is connected to an inner cavity present between the catalyst bodies, an outer cavity connected to the outlet is present between the wall and the catalyst bodies and the passages of the catalyst bodies run from the inner cavity to the outer cavity.

According to the invention, sheet metal members having coatings are first produced. Thereafter, sheet metal members already having coatings are stacked one on top of the other to form a packet and are arranged between two walls in such a manner that the sheet metal members together bound passages for the gas. This sequence of process steps makes it possible to apply, in a simple and economical manner, coatings to the entire surfaces which subsequently border the passages in the finished catalyst body, application being possible even when the passages are provided with small cross-sectional dimensions.

The coatings contain catalytically active material, namely preferably at least one noble metal, for example platinum and rhodium. The coatings preferably contain a porous nonmetallic material which serves for the formation of a rough, large surface, contains at least one oxide, for example aluminum oxide, and forms the so-called wash coat. This nonmetallic material may then form the largest part of the coating in terms of volume and weight. The process according to the invention makes it possible to apply the coatings so uniformly to the surface of the sheet metal members that they have about the same thicknesses, structures and compositions over the entire surfaces. In the formation of a coating, for example, at least one nonmetallic material and at least one catalytically active noble metal can be applied simultaneously to a metallic substrate serving for the formation of sheet metal members, for example can be sprayed on together with a liquid dispersant and/or solvent. It is also possible to apply coating materials having different compositions in succession to a substrate.

It was found, surprisingly, that sheet metal members whose two surfaces facing away from one another are provided or formed, completely and up to the edges to be connected to the walls, with coatings consisting for the most part of nonmetallic material can also be connected permanently and durably to the walls by fusion of metallic material, namely by welding.

BRIEF DESCRIPTION OF THE DRAWINGS

The subject of the invention is illustrated in more detail below with reference to embodiments shown in the drawings. In the drawings.

It should also be pointed out that various Figures are shown schematically and in some cases not to scale.

DETAILED DESCRIPTION OF THE PREFERRED EMBODIMENTS

Figure 1:
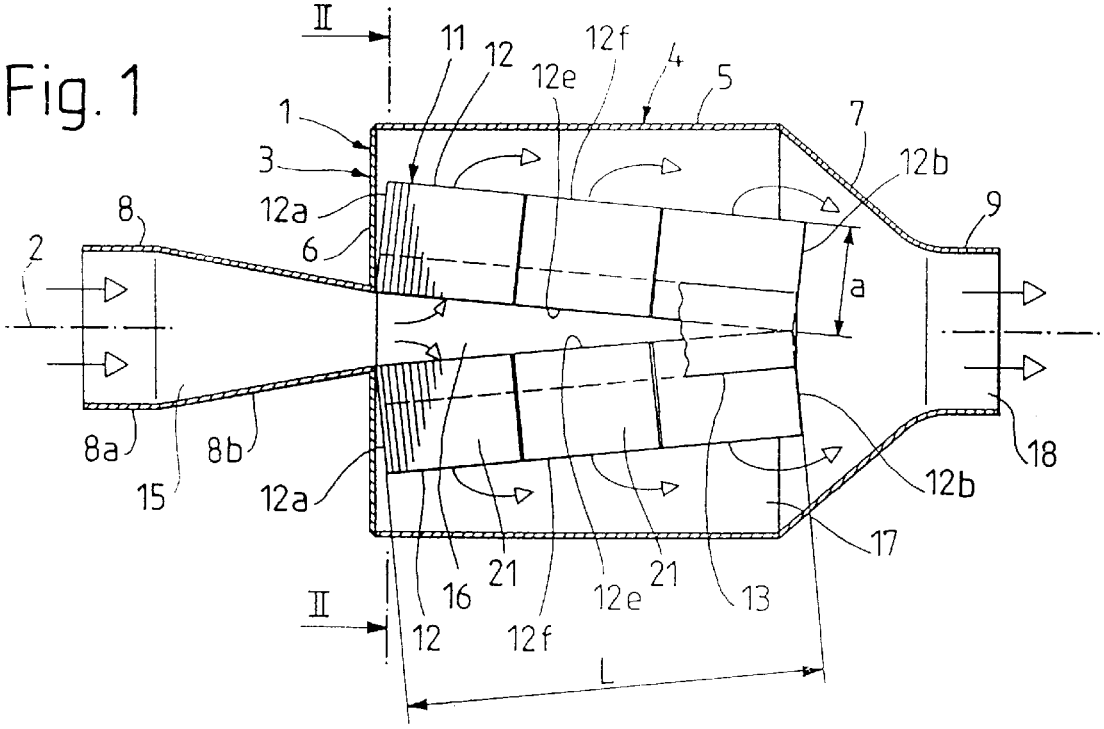
FIG. 1 shows a longitudinal section through a catalytic converter having two catalyst bodies which are arranged in a V-shape and each of which has three blocks with a packet of sheet metal members.
Figure 2:
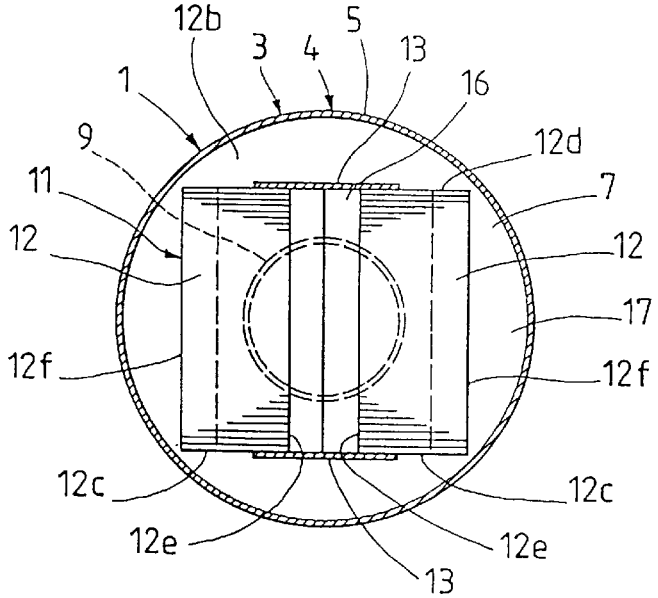
FIG. 2 shows a cross-section through the catalytic converter along the line II—II in FIG. 1.

The catalytic converter 1 shown in FIGS. 1 and 2 serves for the catalytic treatment of gas, namely for the catalytic treatment of exhaust gas from an internal combustion engine. The catalytic converter 1 defines an axis 2 and has a housing 3. Its wall 4 has a plurality of wall parts, namely a parallel, for example cylindrical, casing 5 coaxial with the axis 2 and circular in cross-section, a flat end wall 6 and an end wall 7 tapering conically away from the casing 5.

The housing 4 is provided with an inlet 8 and an outlet 9. The inlet 8 has a cylindrical segment 8*a* which is coaxial with the axis 2 and circular in cross-section and which is connected to the end wall 6 by a transition segment 8*b*. The outlet 9 is coaxial with the axis 2, essentially cylindrical and connected to the end wall 7. The various wall parts, the inlet 8 and the outlet 9 consist of a metallic material, for example stainless steel, and are rigidly and tightly connected to one another, for example welded but could instead be connected at least partly by flange connections.

The interior of the housing 3, which is sealed tightly from the environment, contains catalyst means having two elongated catalyst bodies 12. These are arranged in a V-shape in the longitudinal section shown in FIG. 1 and passing through the axis 2. Each catalyst body 12 has essentially the shape of a parallelepiped, namely of a cuboid. Each catalyst body 12 accordingly has six surfaces which face away from one another in pairs and are parallel to one another in pairs, namely a first surface or end surface 12*a*, a second surface or end surface 12*b* facing away from said first surface, a third surface or base surface 12*c*, a fourth surface or top surface 12*d* facing away from said base surface, a fifth surface or inner mouth surface 12*e* and a sixth surface or outer mouth surface 12*f* facing away from said inner mouth surface.

The two catalyst bodies 12 are connected firmly and tightly, namely welded, to the end wall 6 at the edges between the end surfaces 12*a* and the inner mouth surfaces 12*e*. The two catalyst bodies abut one another at the edges present between the end surfaces 12*b* and the inner mouth surfaces 12*e* and are firmly and tightly connected, namely welded, to one another there. Furthermore, two plates 13 are present, one of which is adjacent to the base surfaces 12*c* and the other to the top surfaces 12*d* of the two catalyst bodies 12. The two plates 13 consist of steel and are firmly and tightly connected, namely welded, to the catalyst body 12 over its entire length. Furthermore, the two plates 13 are firmly and tightly connected, namely welded, to the end wall 6, at least in the middle region of their edges facing the inlet 8.

The inlet 8 surrounds in cross-section an inlet passage 15. This enters at the end wall 6 into an inner cavity 16 surrounded in cross-section by the two catalyst bodies 12 and the two plates 13. Said cavity has a quadrilateral, namely rectangular, cross-section at its end connected to the inlet. The casing of the transition segment 8*b* is inclined relative to the axis 2, at least in certain circumferential regions, so that that segment of the inlet passage 15 which is bounded by said sleeve has, at its end connected to the inner cavity 16, approximately the same cross-sectional dimension as the inner cavity 16. The width and the cross-sectional area of the inner cavity 16 decrease linearly to at least approximately the value zero in the direction away from the inlet 8, so that the inner cavity 16 tapers at least approximately to a straight line at its end facing away from the inlet. An outer cavity 17 is present between inner surfaces of wall parts of the housing 3 and the catalyst bodies 12 and the plates 13 and is connected to an outlet passage 18 surrounded in cross-section by the outlet 9. The inner mouth surface 12*e* of each catalyst body 12 is adjacent to the inner cavity 16 and the outer mouth surface 12*f* of each catalyst body 12 is adjacent to the outer cavity 17.

One of the catalyst bodies 12 will now be described in more detail with reference to FIGS. 3, 4 and 8. Each catalyst body 12 is composed of at least two, and namely three, essentially identically formed and dimensioned blocks 21 rigidly connected to one another. Each block 21 has in general the shape of a parallelepiped, namely of a cuboid, so that those surfaces of each block 21 which abut one another are at right angles to one another in pairs. Each block has a sleeve 22 which is open at both ends and is essentially quadrilateral, namely rectangular, in cross-section and, arranged therein, a packet 24 of compact, i.e. unperforated, alternating, separate first sheet metal members 25 and second sheet metal members 26. Each sleeve has a first wall 22*a*, a second wall 22*b*, a third wall 22*c* and a fourth wall 22*d*. The four walls 22*a*–22*d* are essentially flat but may be connected to one another by transition segments curved with small radii of curvature. At least prior to connection to the sheet metal members, outer and inner surfaces are essentially flat and smooth, i.e. free of grooves or ribs or other indentations and protuberances. The first wall 22*a* and the second wall 22*b* face away from one another and are parallel to one another and to the end surfaces 12*a*, 12*b* of the catalyst body 12. The third wall 22*c* and the fourth wall 22*d* face away from one another and are parallel to one another and to the base surface 12*c* and to the top surface 12*d* of the catalyst body 12. The sleeves 22 adjacent to one another have their flat outer surfaces adjacent to a first wall 22*a* or a second wall 22*b* and are rigidly connected to one another at the abutment points. The three sleeves are welded to one another, for example along those edges of the adjacent walls which are vertical in FIG. 3.

Each sheet metal member 25, 26 has four corners, a first edge 25*a* or 26*a*, a second edge 25*b* or 26*b*, a third edge 25*c* or 26*c* and a fourth edge 25*d* or 26*d*. The four edges of each sheet metal member are completely straight, at least in a plan view of said member. The sheet metal members 25, 26 therefore have the shape of a rectangular parallelogram, namely of a rectangle, in plan view. The first sheet metal members 25 are completely flat. The second sheet metal members 26 are provided everywhere with corrugations 26*e*. These are straight and are parallel to one another and to the first and second edges 26*a*, 26*b*. Each second sheet metal member 26 defines two flat osculating surfaces which conform to the sheet metal member on the lower or upper side of the sheet metal member at the summits of the corrugations 26*e*. The sheet metal members 25, 26 are arranged in the associated sleeve 22 in such a way that the first, flat sheet metal members 25 and the flat osculating surfaces defined by the second sheet metal members are parallel to the base surface 12*c* and to the top surface 12*d* of the catalyst body 12 and to the walls 22*c*, 22*d* of the sleeve 22. The first and second edges 25*a*, 25*b*, 26*a*, 26*b* of the sheet metal members face away from one another and, over their entire lengths, face the inner surfaces of the walls 22*a*, 22*b* parallel to these edges. The sheet metal members fit tightly between the first and second walls or, between these, have a small play of for example not more than 0.5 mm, so that the first and second edges of all sheet metal members abut at least approximately the inner surfaces of the first or second walls. Each sheet metal member 25, 26 is firmly connected, namely welded, to the first wall 22*a* in a manner described in more detail, at at least one edge segment and namely at two or possibly more edge segments of its first edge 25*a* or 26*a*, which segments are a distance apart from one another. Each sheet metal member 25, 26 is furthermore firmly connected, namely welded, to the second wall 22*b* at at least one edge segment and namely at two or possibly more edge segments of its second edge 25*b* or 26*b*, respectively, which are spaced a distance apart from one another. The weld joints connecting the walls 22*a*, 22*b* to the sheet metal members are present on two strip-like regions of the walls 22*a*, 22*b* and are shown schematically by dots in FIGS. 3, 4 and 8 and denoted by 27. The strip-like regions run at right angles to the walls 22*c* and 22*d*. Each second sheet metal member 26 which is not at the end of a packet 24 is adjacent, at the summits of its corrugations 26*e*, to the two flat, first sheet metal members 25 adjacent thereto. For example, the second sheet metal members 26 whose wave summits are adjacent to the walls 22*c* or 22*d* may be present at the two ends of a packet 24. The sheet metal members together in pairs bound passages 29 which are separated from one another and run parallel to the first and second edges 25*a*, 26*a*, 25*b*, 26*b* from the third edges 25*c*, 26*c* to the fourth edges of the sheet metal members 25 and 26, respectively. The sheet metal members 25, 26 of a packet 24 together form a matrix which essentially completely fills the relevant sleeve 22—apart from the passages 29. The third edges 25*c*, 26*c* of the sheet metal members are flush with those edges of the sleeve walls which are present on the relevant side of the sleeve 22. The same applies to the fourth edges 25*d*, 26*d* of the sheet metal members and those edges of the sleeve 22 which are present at these edges.

Figure 3:
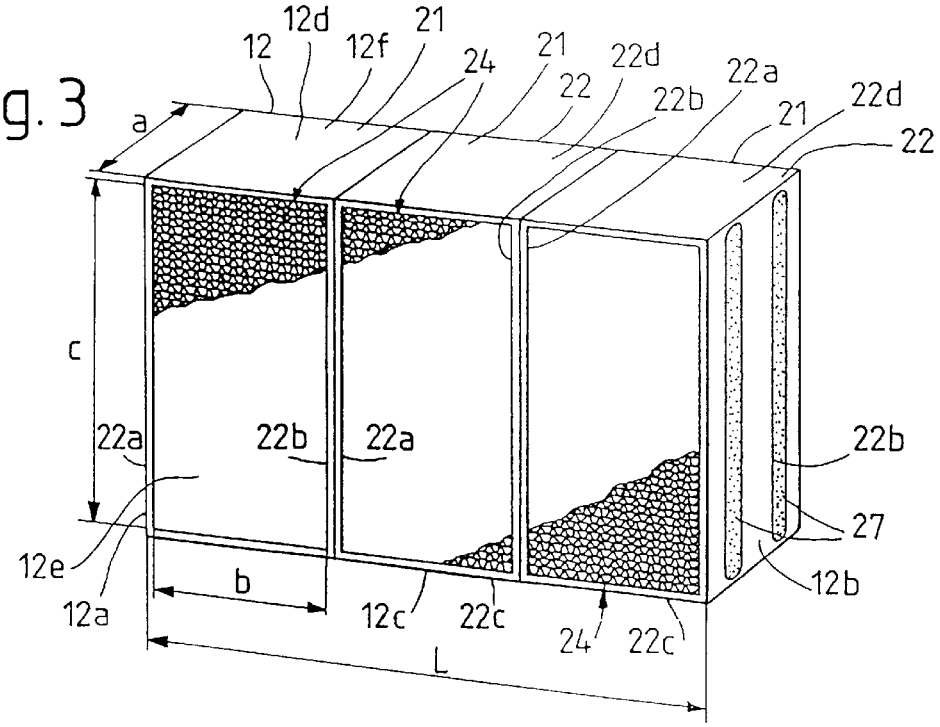
FIG. 3 shows an oblique view of a catalyst body.
Figure 4:
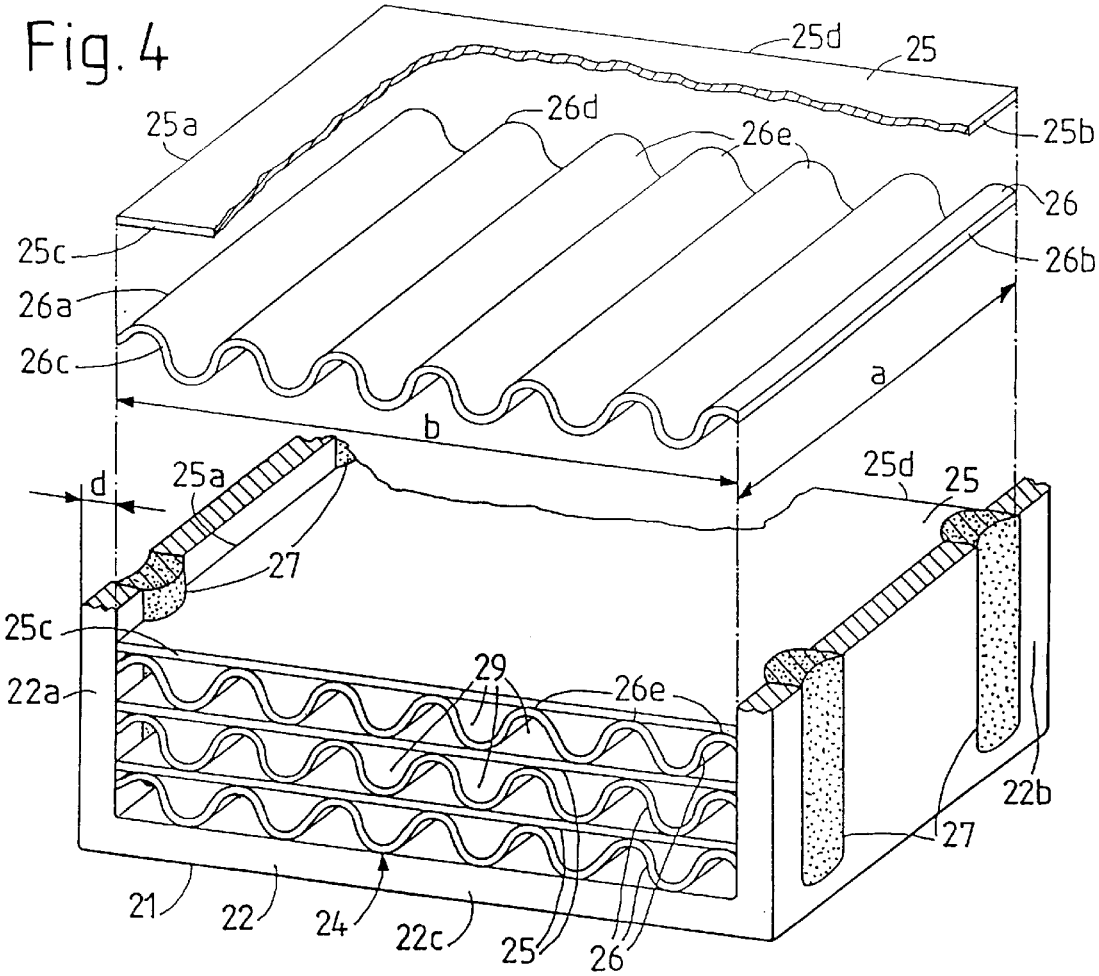
FIG. 4 shows an oblique view of a part of one of the blocks of a catalyst body on a larger scale than that of FIG. 3.

The outer surface of the first wall 22*a* of the sleeve present at the left end of the catalyst body 12 in FIG. 3 forms the end surface 12*a* of the catalyst body 12. The outer surface of the second wall 22*b* of the sleeve 22 which is present on the outer right in FIG. 3 forms the end surface 12*b* of the catalyst body 12. The outer surfaces of the third wall 22*c* of the three sleeves 22 together form the base surface 12*c* of the catalyst body 12. The outer surfaces of the fourth wall 22*d* of the three sleeves 22 together form the top surface 12 of the catalyst body 12. The third edges 25*c*, 26*c* of the sheet metal elements of the three blocks 21 and those edges of the sleeve walls which are present at these edges together form the inner mouth surface 12*e*. The fourth edges 25*d*, 26*d* of the sheet metal members of the three blocks 21, together with those edges of the sleeve walls which are flush with these edges, form the outer mouth surface 12*f*. The passages 29 have entrances lying in the mouth surfaces 12*e*, 12*f*.

Figure 8:
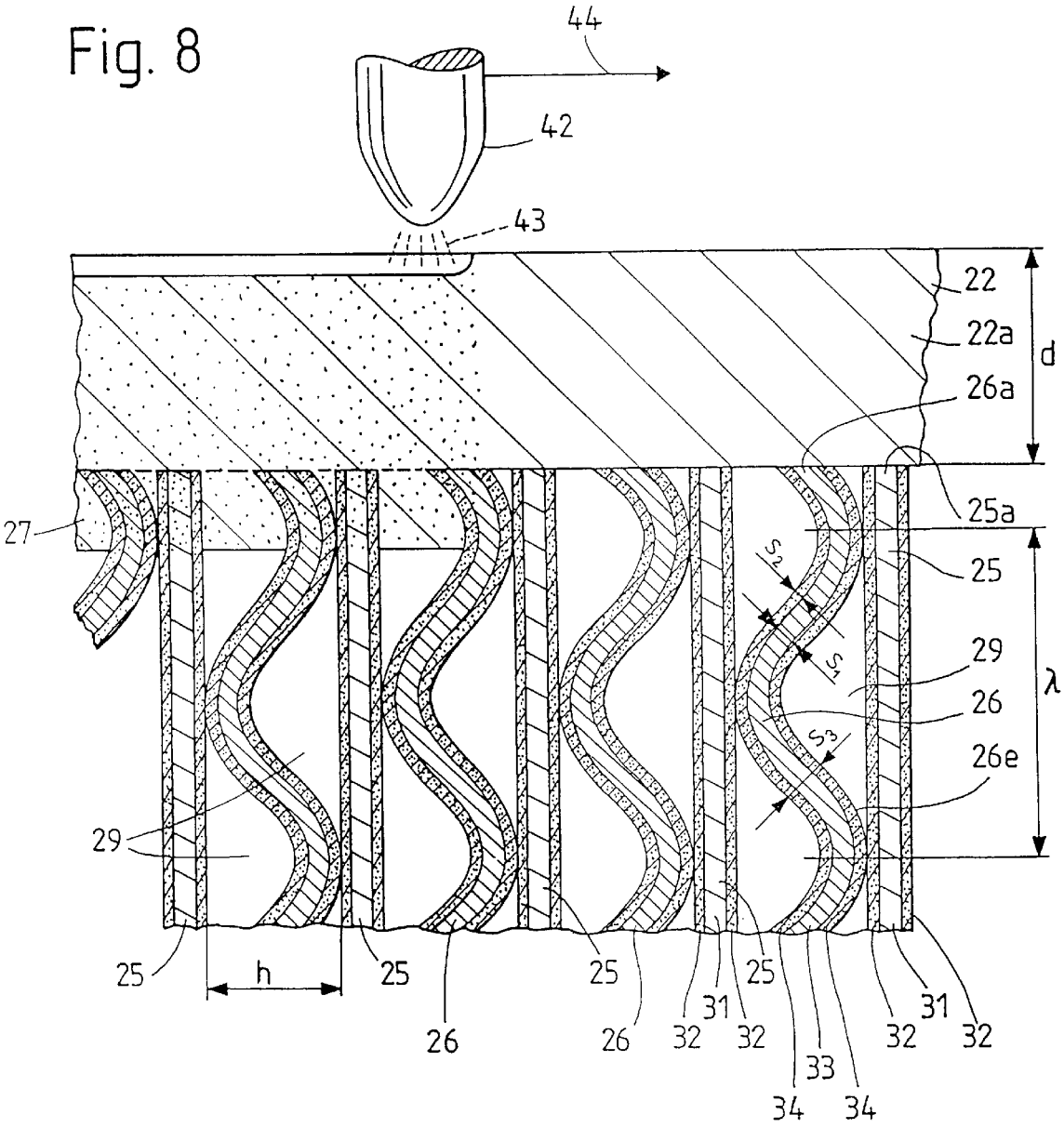
FIG. 8 shows a cross-section, at right angles to the passages of a catalyst body, through regions of a wall and some sheet metal members during welding of the wall to the sheet metal members, essentially on a larger scale than that of FIGS. 1 and 2.

Each sheet metal member 25, 26 has a metallic core 31 or 33 which is shown in FIG. 8, consists of steel and is formed from a metal lamella. A coating 32 or 34 which completely covers the two surfaces of the core 31, 33 is applied to both surfaces of the cores or metal lamellae of the sheet metal members 25, 26, said surfaces facing away from one another.

Each coating 32 or 34 consists for the most part of the nonmetallic, porous wash coat. Each coating furthermore contains catalytically active material which comprises at least one noble metal, for example platinum and rhodium, and covers, at least more or less completely, for example, that surface, of each wash coat which faces away from the core 31 or 33.

Each packet 24 and its sheet metal members 25, 26 have a dimension a measured parallel to the first and second edges 25*a*, 26*a* and 25*b*, 26*b*, respectively, of the sheet metal members. This dimension is equal to the distance between the third edges 25*c*, 26*c* and the fourth edges 25*d*, 26*d* and is, for example, about 30 mm. Each packet and its sheet metal members 25, 26 have a dimension b measured, in the plan view of the sheet metal members, parallel to the third and fourth edges 25*c*, 25*d*, 26*c*, 26*d* of the sheet metal members 25 and 26, respectively, and at right angles to the corrugations 26*e* and parallel to the flat osculating surfaces conforming to said corrugations. Said dimension b is equal to the distance, measured in the plan view of the sheet metal members, between the first edges 25*a*, 26*a* and the second edges 25*b*, 26*b*, of the sheet metal members and at least approximately equal to the distance between the facing inner surfaces of the walls 22*a*, 22*b* of a sleeve 22. The dimension b is preferably not more than 50 mm, preferably at least 20 mm, expediently from 30 mm to 40 mm and namely, for example, about 35 mm. Each packet 24 has a dimension c at right angles to the flat sheet metal members 25 and the stated, flat osculating surfaces. This dimension is, for example, greater than the dimension b and is preferably from 60 mm to 80 mm and, for example, about 70 mm. The walls of the sleeves 22 all have the same thickness d. This is preferably not more than 2 mm and, for example, about 1.5 mm. Each catalyst body 12 has a length L at right angles to the end surfaces 12*a*, 12*b*. In a catalyst body having three blocks 21, the length is $L=3b+6d$. Thus, if for example b is equal to 35 mm and d is equal to 1.5 mm, the length L is 114 mm.

The thickness of the metallic cores 31, 33 which is indicated in FIG. 8 by $S_1$ is preferably not more than 0.1 mm and, for example, about 0.05 mm. The thickness $s_2$ of the coatings 32 and 34 is preferably not more than 0.1 mm and, for example, about 0.03 mm. The thickness $s_3$ of a sheet metal member 25 or 26 having coatings 32, 34 on two surfaces facing away from one another is accordingly not more than 0.3 mm and, for example, about 0.11 mm. FIG. 8 also indicates the wave height h. This is measured between surfaces facing away from one another, from wave summit to wave summit of a second sheet metal member 26 provided with coatings 34, and is accordingly equal to the distance between the facing surfaces and two flat sheet metal members 25 adjacent to one another. The wave height h is preferably not more than 1 mm and, for example, from about 0.5 mm to 0.7 mm. The wavelength $\lambda$ likewise indicated in FIG. 8 is preferably at least equal to the wave height h and is preferably not more than 4 times the wave height. The wavelength may be, for example, from about 1 mm to 2 mm. In a cross-section at right angles to the corrugations, a packet of sheet metal members preferably has at least 150 passages per $cm^2$ and, for example, about 193 passages per $cm^2$ (about 1250 passages per square inch). It should also be noted that the thicknesses of the sheet metal members and the wave heights and the wavelengths in the various Figures are not drawn to scale and that, for example, the thicknesses of the sheet metal members, the wave height and the wavelength are actually smaller than in FIG. 4 in comparison with the dimension b.

Figure 5:
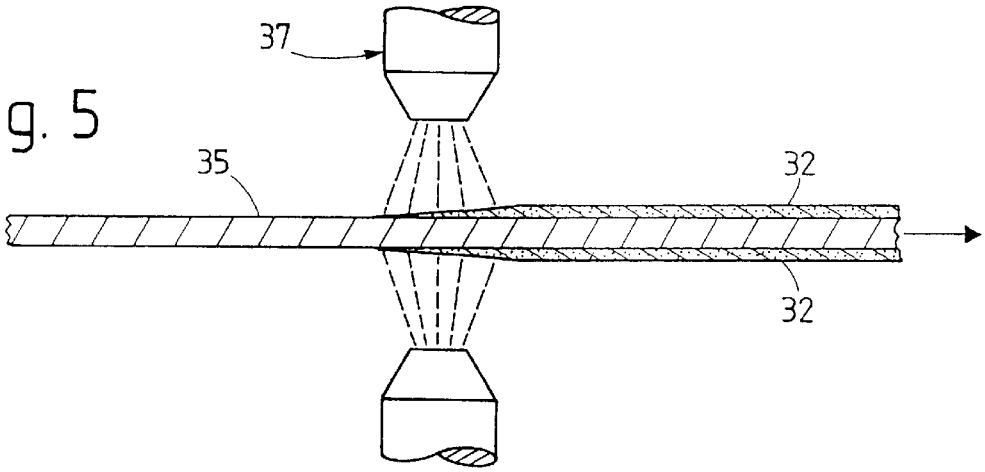
FIG. 5 shows a longitudinal section through a flat, tape-like, metallic substrate during spraying on of coating material.
Figure 6:
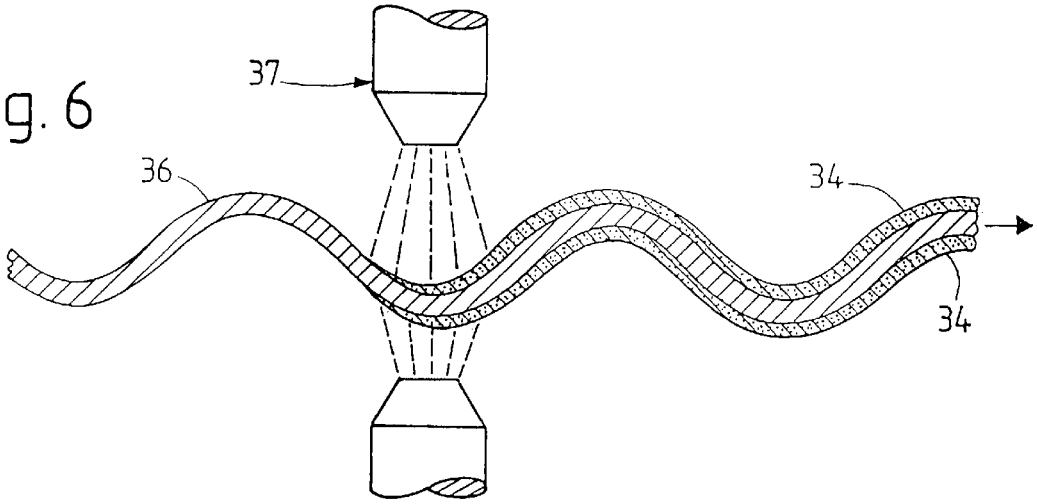
FIG. 6 shows a longitudinal section through a corrugated, tape-like, metallic substrate during spraying on of coating material.
Figure 7:
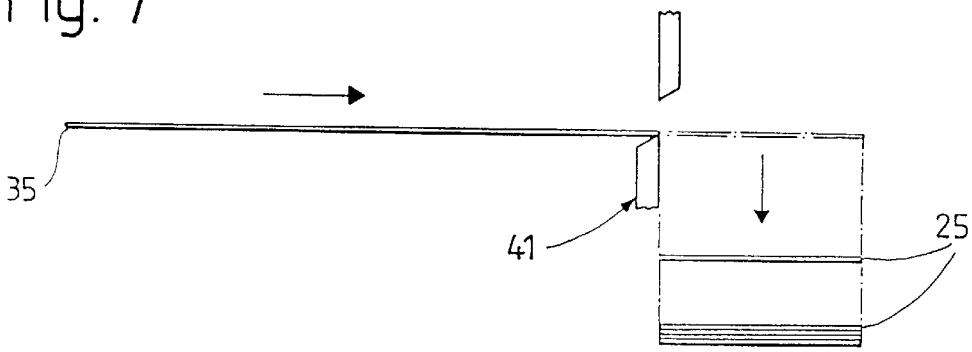
FIG. 7 shows a cutting device for cutting a tape-like substrate provided with coatings.

In the production of the catalyst means 11, for example, sleeves 22 having the intended dimensions and sheet metal members 25, 26 having coatings and the intended dimensions can first be produced. The sleeves 22 can, for example, be cut from a pipe which has a lateral surface quadrilateral in cross-section and which is welded at a weld seam running in its longitudinal direction. For the formation of the sheet metal members 25, 26, a flat, tape-like substrate 35 shown in FIG. 5 and a tape-like substrate 36 shown in FIG. 6 and having corrugations transverse to its longitudinal direction can first be produced. The tape-like substrates 35, 36 consist of untreated sheet metal and have a width which is equal to the intended dimension a. The substrates are then transported in their longitudinal direction past a spray apparatus 37, as indicated by arrows in FIGS. 5, 6. Those two surfaces of the substrates 35, 36 which face away from one another are sprayed by means of the spray apparatus 37 in one pass or in a plurality of passes with liquid coating materials, which coatings, after drying, are denoted by 32 or 34 in FIGS. 5, 6, as in the case of the coatings of the finished sheet metal members, and cover the substrates continuously over the entire widths and in all directions. The substrate 35 provided with coatings is then fed stepwise in its longitudinal direction to a separating device 41 shown in FIG. 7 and is separated, i.e. cut, by this into flat sheet metal members 25 whose metallic cores 31 consist of segments of the originally tape-like substrate 35. The corrugated substrate 36 provided with coatings is cut analogously into corrugated sheet metal members 26.

Sheet metal members 25, 26 are then stacked alternately one on top of the other and the resulting stacks or packets 24 are inserted into sleeves 22. Thereafter, the sheet metal members are firmly connected, namely welded, to the walls 22*a* at their edges 25*a*, 26*a*, 25*b*, 26*b* by temporary fusion of metallic material. At least one welding device 42 indicated in FIG. 8 and having at least one electrode is used for welding. During welding, two strip-like regions of the wall can be welded to the sheet metal members, for example in succession at each wall 22*a*, 22*b*. The sleeve 22 is arranged, for example, in such a way that its wall 22*a* which is about to be welded is located above the sheet metal members 25, 26 and is approximately horizontal. With the electrode, an arc 43 is generated on that side of the wall 22*a* of the sleeve 22 which faces away from the sheet metal members 25, 26, which wall is to be welded to said sheet metal members. The electrode is, for example, moved continuously in the direction of the arrow 44, at right angles to the edges 25*a*, 26*a* of the sheet metal members 25 and 26, respectively, along the wall 22*a* relative to the sleeve 22. The welding device is furthermore formed to generate an envelope of an inert gas, for example at least one noble gas, or carbon dioxide, surrounding the free end of the electrode and the arc. In the welding process, a strip-like region of the wall 22*a* is temporarily softened and/or more or less melted. Furthermore, for example, an additional material is introduced. This may be achieved in the form of a separate welding wire, which is not shown, or by using an electrode which contains the additional material and melts during welding. Temporarily melted metallic material, namely wall material and/or melted additional material, then flows between those regions of the sheet metal members 25, 26 which are adjacent to the edges 25*a*, 26*a*. The metallic, temporarily melted material indicated by dots in FIGS. 3, 4 and 8 can then also cover regions of the coatings 32, 34 and penetrate into pores thereof. After solidifying, the material flowing between regions of the sheet metal members 25, 26 forms protuberances which are shown in FIGS. 4 and 8 and which project away from the remaining, flat inner surface of the wall 22*a* into the interior of the sleeve. The amount of the additional material introduced is such that the additional material at least approximately replaces the inward-flowing wall material, so that no slit is formed right through the wall. However, when the weld joint 27 is produced, preferably no bead projecting outward above the remaining, flat outer surface of the wall but rather a small indentation should be formed, so that the flat outer surfaces of the sleeves 22 can subsequently rest against one another without subsequent machining. During the welding process, for example, an edge region of a sheet metal member which is instantaneously present in the vicinity of the arc 43 is heated through the wall 22*a* and likewise softened and/or more or less melted so that the cores 31, 33 of the sheet metal members fuse with the wall. During welding, the coatings 32, 34 may in fact be slightly damaged. Any damage to the coatings is however limited to very small regions thereof adjacent to the welded edge sections of the sheet metal members.

The catalytic converter 1 can be used, for example, by installing it in an exhaust gas pipe of an exhaust system of the gasoline combustion engine of an automobile. During operation of the catalytic converter 1, an exhaust gas flow indicated by arrows in FIG. 1 forms in said catalytic converter. The exhaust gas flows through the inlet 8 into the inner cavity 16, is deflected therein and flows into the inner ends of the passages 29 at the inner, second mouth surfaces 12*e* of the two catalyst bodies 12, which mouth surfaces serve as exhaust gas entry surfaces and face one another. The exhaust gas then flows through the passages 29 to the outer mouth surfaces 12*f* of the two catalyst bodies 12, which mouth surfaces face away from one another. The exhaust gas is catalytically treated, in particular purified and detoxified, while flowing through the passages 29, emerges from the catalyst bodies 12 at the outer mouth surfaces 12*f* serving as exhaust gas outlet surfaces and then flows through the outer cavity 17 to the outlet 9.

That transition segment 8*b* of the inlet 8 which extends from the cylindrical segment 8*a* of the inlet 8 to the inner cavity 16 helps to ensure that virtually no turbulence and only a small pressure loss occur when the exhaust gas flows into the inner cavity 16.

The catalyst bodies 12 are mechanically connected to the wall 4 of the housing 3, for example exclusively at the first end surfaces 12*a*, so that the catalyst bodies can release heat into the environment only at the end surfaces 12*a*, by thermal conduction via solid metallic parts. Furthermore, the exhaust gas flows out of the inlet 8 directly into the inner cavity 16. This is virtually completely separated from the wall 4 of the housing 3 by the catalyst bodies 12 and the plates 13. Accordingly, the exhaust gas can release virtually no heat to the environment between flowing out of the orifice of the inlet 8 and flowing into the catalyst bodies 12. The two catalyst bodies 12 likewise release heat only relatively slowly to the environment via the housing wall. During a cold start—i.e. when the catalytic converter 1 and the engine are still at ambient temperature on starting of the engine—at least those regions of the catalyst bodies 12 which are adjacent to the inner cavity 16 are therefore rapidly heated by the exhaust gas to a temperature which permits an effective catalytic treatment of the exhaust gas.

The inclination of the inner mouth surfaces 12*f* relative to the axis 2 and the linear decrease in the cross-sectional area of the inner cavity 16, resulting therefrom with increasing distance from the inlet, causes the exhaust gas, on flowing into the catalyst bodies 12, to be uniformly distributed over the entire, relatively large, inner mouth surfaces 12*e* serving as an exhaust gas entry surface and accordingly uniformly over all passages 29. This permits uniform utilization of all passages 29 for the catalytic treatment and helps to ensure that the catalyst means can be made small and light and can be produced economically and nevertheless cause only a small pressure loss.

The small cross-sectional dimensions of the passages 29 ensure that, on flowing through the passages, the exhaust gas makes intensive contact with the catalytically active material of the coatings 32 and 34. The intensive contact of the exhaust gas with the catalytically active material results in high catalytic efficiency. This high catalytic efficiency helps to ensure that the catalyst means and the entire catalytic converter can be made relatively small and light—based on a predetermined, maximum flow rate of the exhaust gas flowing through the two catalyst bodies. Accordingly, the production of the catalyst means requires only a relatively small amount of the catalytically active material consisting of expensive noble metals and also only a small amount of the likewise rather expensive metallic material forming the cores 31, 33.

After flowing out of the catalyst bodies 12, the exhaust gas can distribute itself over the outer cavity 17 completely enclosing the catalyst means 11 in cross-section. When the exhaust gas flows from the catalyst bodies through the outer cavity 17 into the outlet passage 18, only a small pressure loss therefore also results in the outer cavity.

During operation, the catalyst means 11 are heated —starting from the ambient temperature—to temperatures which are more than 500° C., at least in parts. When the operation is interrupted or terminated, the catalyst means are cooled again to ambient temperature, the various parts of the catalyst means 11 expanding and contracting again. Furthermore, the engine producing the exhaust gas causes vibrations which, together with the accelerations caused by driving the automobile, have an effect on the catalytic converter. The corrugations 26*e* stiffen the sheet metal members 26, the corrugations 26*e* also supporting the flat sheet metal members 25 resting against them. Since the dimension b of the sheet metal members is substantially smaller than the length L of an entire catalyst body 12, the sheet metal members suffer only relatively little deformation and bending during operation owing to the temperature changes and the accelerations acting on the catalyst means. This together with the weld joints 27 connecting the sheet metal members to the walls 22*a* and 22*b* and the stiffening by the corrugations 26*e* helps to ensure that the sheet metal members at least substantially retain their intended shapes and dimensions even after prolonged use of the catalytic converter and after many changes and interruptions of the exhaust gas supply and resulting temperature changes. It is also possible in particular substantially and virtually completely to avoid adjacent sheet metal members bending away from one another over a plurality of wavelengths in a cross-section transverse to the corrugations.

Since the walls of the sleeves 22 are relatively thin in comparison with the external dimensions of the catalyst bodies and in particular in comparison with the length L, the walls of the sleeves 22 and in particular the walls 22*a*, 22*b* occupy only a relatively small part of the total surface area of that inner mouth surface 12*e* of a catalyst body which is adjacent to the inner cavity 16. Accordingly, the sleeves 22 produce only a small reduction of that volume of the catalyst bodies 12 which can be used for the catalytic treatment. Furthermore, the sleeves 22 increase the weight of the catalyst bodies by only a relatively small amount.

Figure 9:
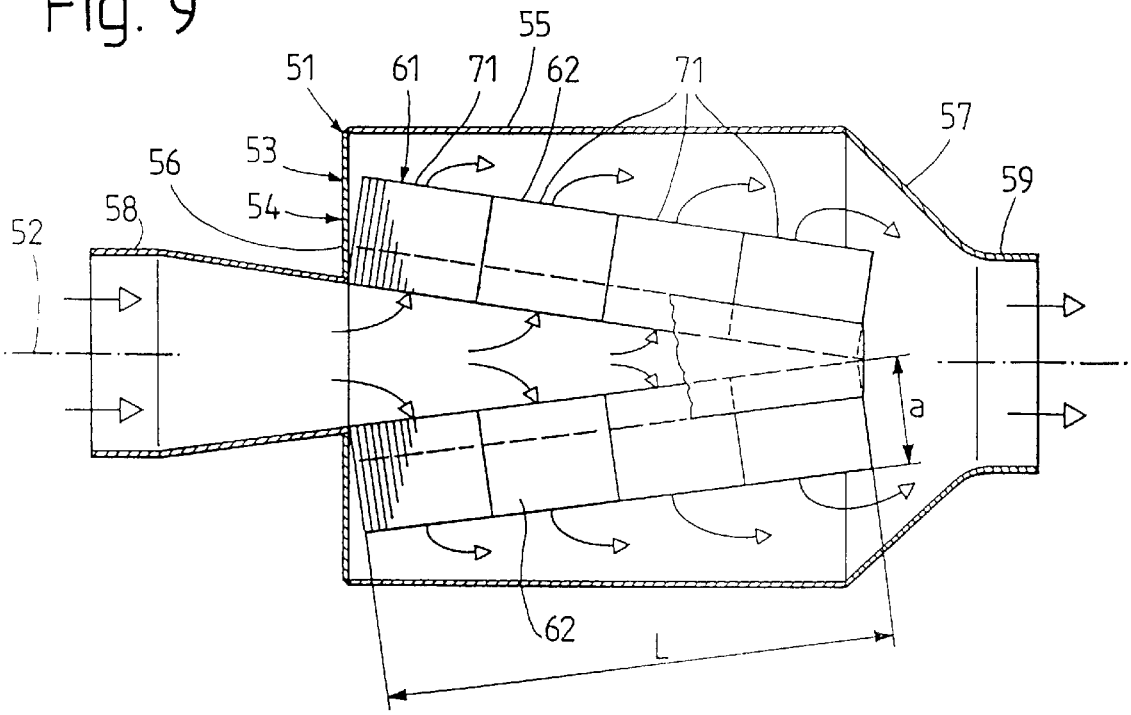
FIG. 9 shows a longitudinal section analogous to FIG. 1, through a catalytic converter having two catalyst bodies, each of which has four blocks with a packet of sheet metal members.

The catalytic converter 51 shown in FIG. 9 defines an axis 52 and has a housing 53 with a wall 54. The latter has a casing 55 which is parallel to the axis 52 but may be oval or flattened in cross-section so that the casing has a cross-sectional dimension, measured parallel to the plane of the drawing, which is greater than the cross-sectional dimension measured at right angles to the plane of the drawing. In addition, the housing 53 has two end walls 56, 57, an inlet 58 and an outlet 59. The housing 53 contains catalyst means 51 having two catalyst bodies 62 which are arranged in a V-shape in the longitudinal section shown. Each catalyst body 62 has four blocks 71 rigidly connected to one another. Each block 71 has a sleeve and a packet of sheet metal members which is arranged therein, which sheet metal members are formed similarly to the sheet metal members 25 and 26. The dimension a of the sheet metal members and sleeves of a block 71, measured parallel to the corrugations, is, for example, slightly greater than the dimension a of the sheet metal members 25, 26 and is, for example, about 40 mm. The dimension b of the sheet metal members of the blocks 71 which is measured at right angles to the corrugations and is not shown in FIG. 9 is, for example, about 35 mm, as in the case of the sheet metal members 25, 26 of the blocks 21. The walls of the sleeves of the blocks 71 may have, for example, a thickness of 1.5 mm, as in the case of the walls of the sleeves 22 of the blocks 21. The length L of a catalyst body 62 is then, for example, about 152 mm. Unless stated otherwise above, the catalytic converter 51 may be formed similarly to the catalytic converter 1.

Figure 10:
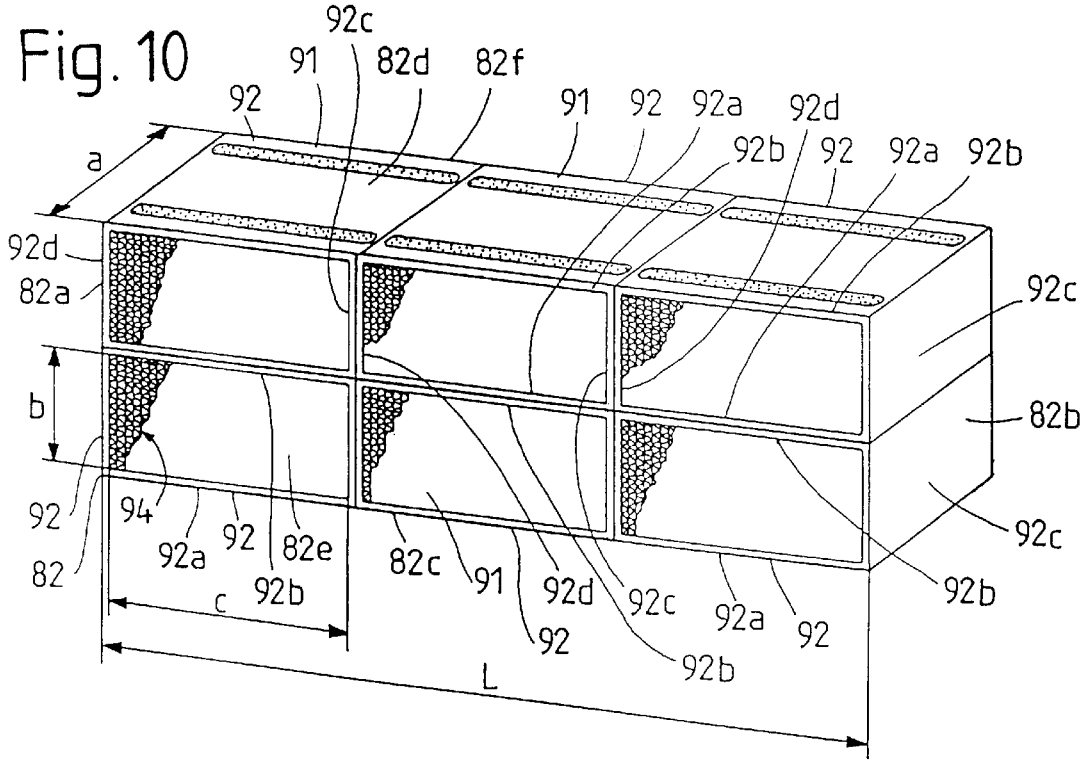
FIG. 10 shows an oblique view of a catalyst body having two rows of blocks connected to one another, each of which has a packet of sheet metal members.

The catalyst body 82 shown in FIG. 10 is cuboid, as in the case of the catalyst bodies 12 and 62, and has two end surfaces 82*a*, 82*b* facing away from one another, a base surface 82*c*, a top surface 82*d* facing away from said base surface, an inner mouth surface 82*e* and an outer mouth surface 82*f* facing away from said inner mouth surface. The catalyst body 82 can be arranged in a housing, for example together with a mirror-image catalyst body, in such a way that its inner mouth surface 82*e* bounds an inner cavity and its outer mouth surface 82*f* bounds an outer cavity.

The catalyst body 82 has two rows of blocks 91 arranged one on top of the other. Each block 91 has a sleeve 92 rectangular in cross-section and having a first wall 92*a*, a second wall 92*b* parallel thereto, a third wall 92*c* and a fourth wall 92*d* parallel to this. The sleeves 92 of the upper row rest, with the first wall 92*a*, against the second wall 92*b* of a sleeve 92 of the lower row. Furthermore, the middle sleeve of each of the two rows rests with its walls 92*c* and 92*d* against the walls 92*d* and 92*c*, respectively, of an adjacent sleeve. The adjacent sleeves are welded to one another. Each sleeve 92 contains a packet 94 of alternate flat and corrugated sheet metal members. The flat sheet metal members and the flat osculating surfaces defined by the corrugated sheet metal members are parallel to the end surfaces 82*a*, 82*b* of the catalyst body and to the walls 92*c*, 92*d* of the sleeves 92.

The end surfaces 82*a*, 82*b* of the catalyst body 82 are formed by the walls 92*d* and 92*c*, respectively, of two sleeves 92. The base surface 82*c* and the top surface 82*d* are formed by the walls 92*a* and 92*b*, respectively, of the lower and upper sleeves, respectively. The inner mouth surface 82*e* of the catalyst body 82 is formed by the third edges of the sheet metal members and those edges of the sleeves 92 which are flush therewith. The outer mouth surface 82*f* is formed by the fourth edges of the sheet metal members and those edges of the sleeves which are flush with these edges.

The dimension a, measured parallel to the corrugations, of the sheet metal members and the sleeves 92 may be, for example, from 30 mm to 100 mm. The dimension b, measured at right angles to the corrugations, of the sheet metal members may be, for example, about 35 mm, as in the case of the sheet metal members 25, 26. The dimension c, measured at right angles to the flat sheet metal members, of a packet of sheet metal members may be, for example, about 70 mm, as in the case of the catalyst bodies 12. The walls of the sleeves 92 may be, for example, 1.5 mm thick. The length L of the entire catalyst body is then about 219 mm.

The production of the catalyst bodies, these themselves and the catalytic converters can be modified in other ways.

It is possible, for example, to weld two or four strip-like regions of the walls simultaneously to edge segments of the sheet metal members with two or even with four electrodes. Furthermore, the weld joints may be produced without the introduction of an additional material.

Instead of each packet of sheet metal members being inserted individually into a sleeve, it is possible, during the production of the catalyst means, to provide a pipe section whose length is a multiple of the dimension a. Furthermore, it is possible to provide a stack of sheet metal members which have coatings and whose lengths are approximately equal to the length of the pipe section. These sheet metal members can then be introduced into the pipe section. Thereafter, the sheet metal members can be welded in strip-like regions to two walls of the pipe section. The pipe section together with the sheet metal members contained therein can then be separated with the aid of a separation apparatus into pieces in such a way that blocks 21 having a sleeve 22 and a packet 24 of sheet metal members with the dimension a are formed.

Furthermore, the first and the second edges of each sheet metal member can be welded to a wall at more than two edge segments a distance apart from one another. Instead of this, it would also be possible to weld to a wall each first and second edge along its entire length or along only a single cohesive but relatively long edge segment.

Furthermore, it would be possible to use a welding device which has at least one gas burner instead of at least one electrode for welding the sheet metal members to the walls. The sheet metal members and a wall to be welded to these can then be heated during welding with a flame from that side of the wall which faces away from the sheet metal members.

The dimensions of the sleeves and sheet metal members can be varied within certain limits. The dimension b, measured at right angles to the corrugations, of the sheet metal members is however preferably not more than 50 mm, preferably at least 20 mm and, for example, from 30 mm to 40 mm.

Furthermore, a catalyst body may have more than four blocks arranged in a row or possibly only two blocks each having a sleeve and a packet of sheet metal members. The length L of a catalyst body may then be, for example, in the range from about 60 mm to about 500 mm.

It is even possible to produce a catalyst body which has only a single block with a packet of sheet metal members which is arranged between walls of a sleeve.

Furthermore, instead of a sleeve, each block could have only two separate walls between which a packet of sheet metal members is arranged and of which one, first wall is welded to the first edges and the other, second wall is welded to the second edges of the sheet metal members.

In plan view, the sheet metal members may be, for example, square instead of rectangular. Furthermore, the catalyst bodies could have base and top surfaces which have the shape of an acute-angled parallelogram. The shapes of the sleeves and sheet metal members would then have to be appropriately adapted, and the sheet metal members may then likewise be acute-angled in plan view.

Moreover, it might be possible to provide all sheet metal members of a packet with corrugations.

The casings of the housings of the catalytic converters 1 and 51 may be flattened at the upper and lower sides in FIG. 2 or may be approximately rectangular in cross-section and may be adjacent to the base surfaces 12*c* and top surfaces 12*d* of the catalyst bodies 12 or the corresponding surfaces of the catalyst bodies 62.

Furthermore, it is possible to produce a catalytic converter whose casing contains more than two catalyst bodies, for example three or four catalyst bodies. These may then be parallel to the axis of the catalytic converter and may be distributed around this in such a way that they together bound an inner cavity in cross-section. Said cavity may then contain an approximately pyramidal bounding member which, together with the inner mouth surfaces of the catalyst bodies, bounds a free cavity region whose cross-sectional area decreases approximately or exactly linearly in a direction away from the inlet.

What is claimed is:

1. A method of producing a catalyst body for catalytic treatment of exhaust gas from an internal combustion engine and comprising at least one sleeve containing a packet of coated sheet metal members, the method comprising the steps of:

producing the at least one sleeve having a substantially quadrilateral cross-section defined by substantially parallel, spaced from each other, first and second walls and third and fourth walls, with the first and second walls having substantially flat and smooth inner surfaces facing one another;

producing flat sheet metal members and corrugated sheet metal members, with each of the flat and the corrugated sheet metal members having a shape of a parallelogram and opposite straight first and second edges spaced from each other by at most 50 mm in plan view, with corrugations of each of the corrugated sheet metal members being provided along an entire length thereof and extending parallel to the first and second edges of respective corrugated sheets, with each of the flat and corrugated sheet metal members having a metallic core with two opposite surfaces and a core thickness of at most 0.1 mm and smaller than a thickness of the walls of the at least one sleeve, and with each of the two opposite surfaces being completely covered with a coating containing a catalytically active material;

forming, in the at least one sleeve, the packet of the coated sheet metal members by arranging alternatively the flat and corrugated sheet metal members so that the first and second edges of the sheet metal members face respective inner surfaces of the first and second walls of the at least one sleeve, that the flat sheet metal members contact summits of corrugations of respective corrugated sheet metal members, and that the inner surfaces of the first and second walls continuously extend over the first and second edges, respectively, of all of the flat and corrugated sheet metal members; and connecting the sheet metal members to the first and second walls of the at least one sleeve at at least one edge region of each of the first and second edges of the sheet metal members, respectively, by applying heat to respective sides of the first and second walls remote from the sheet metal members in such a manner that metallic wall material is temporarily being melted and by flowing the melted metallic wall material between coated edge regions of essentially all of the adjacent sheet metal members, forming a bond between the sheet metal members and the first and second walls of the at least one sleeve.

2. A method as claimed in claim 1, wherein the arranging step includes arranging the sheet metal members so that the first edges thereof face the respective walls over substantially an entire length of the first edges.

3. A method as claimed in claim 1, wherein the sheet metal members producing step includes producing the sheet metal members having corrugation with a height of the corrugations, measured between opposite corrugation summits being not more than 1 mm and a number of corrugations such that, upon formation of the packet, at least 150 passages per 1 $cm^2$ are formed in a cross-section taken perpendicular to the corrugations.

4. A method as claimed in claim 1, wherein the sheet metal members producing step includes producing a metallic substrate, forming continuous coating on opposite surfaces of the substate and, thereafter, cutting the coated substrate in quadrilateral pieces each of which forms a sheet metal member.

5. A method as claimed in claim 1, wherein the sheet metal members forming step includes forming coatings containing non-metallic metal, at least one noble material and pores, and wherein the connecting step includes filling pores of the edge regions at least partially with the at least one of melted wall material and melted additional material.

6. A method as claimed in claim 1, wherein the connecting step includes supplying an additional metallic material to the side of the first and second walls remote form the sheet metal members and melting the additional metallic material temporarily.

7. A method as claimed in claim 1, wherein the connection procedure includes connecting each first and second walls at least at two strip-like regions spaced from one another with the sheet metal members.

8. A method as claimed in claim 1, wherein the connecting step includes application of heat to at least two strip-like regions of each first and second walls, with each strip-like region extending over all of sheet metal edges facing the respective wall, and with the strip-like regions belonging to the same wall being spaced from one another, so that at least two edge regions of the first and second edges of the sheet metal members are connected to the first and second walls, respectively.

9. A method as claimed in claim 1, wherein the connecting steps includes application of an additional metallic material to the first and second walls and temporarily melting the additional material.

10. A method as claimed in claim 11, wherein the sheet metal members producing step includes covering the sheet metal members with a high-surface coating consisting of a porous non-metallic material, at least one oxide and at least one noble metal serving as said the catalytically active material.

11. A method of producing a catalyst body for catalytic treatment of exhaust gas from an internal combustion engine and comprising at least two sleeves each containing a packet of coated sheet metal members, the method comprising the steps of:

producing the at least two sleeves each having a substantially quadrilateral cross-section defined by substantially parallel, spaced from each other, first and second walls and third and fourth walls, with the first and second walls having substantially flat and smooth inner surfaces facing one another;

producing flat sheet metal members and corrugated sheet metal members, with each of the flat and the corrugated sheet metal members having a shape of a parallelogram and opposite straight first and second edges spaced from each other by at most 50 mm in plan view, with corrugations of each of the corrugated sheet metal members being provided along an entire length thereof and extending parallel to the first and second edges of respective corrugated sheets, with each of the flat and corrugated sheet metal members having a metallic core with two opposite surfaces and a core thickness of at most 0.1 mm and smaller than a thickness of the walls of the sleeves, and with each of the two opposite surfaces being completely covered with a coating containing a catalytically active material;

forming, in each of the at least two sleeves, the packet of the coated sheet metal members by arranging alternatively the flat and corrugated sheet metal members so that the first and second edges of the sheet metal members face respective inner surfaces of the first and second walls of the at least one sleeve, that the flat sheet metal members contact summits of corrugations of respective corrugated sheet metal members, and that the inner surfaces of the first and second walls continuously extend over the first and second edges, respectively, of all of the flat and corrugated sheet metal members;

connecting the sheet metal members to the first and second walls of each of the at least two sleeves at at least one edge segment of each of the first and second edges of the sheet metal members, respectively, by applying heat to respective sides of the first and second walls remote from the sheet metal members in such a manner that metallic wall material is temporarily being melted, flowing the melted metallic wall material between coated edge regions of of essentially all of the adjacent sheet metal members, forming a bond between the sheet metal members and the first and second walls of respective ones of the at least two sleeves; and connecting at least one wall of one of the at least two sleeves with an adjacent wall of another of the at least two sleeves to form the catalyst body.

12. A method as claimed in claim 11, wherein the sheet metal producing step includes producing sheet metal members which, in the plan view, are rectangular.

13. A method as claimed in claim 11, wherein the connecting step includes applying an electric arc to the side of the first and second walls remote from the sheet metal members for temporarily melting metallic wall material, and wherein the connecting steps further includes delivery of an additional metallic material to the first and second walls and temporarily melting of the additional metallic material.

14. A method as claimed in claim 11, wherein the connecting step includes applying flame to the side of the first and second wall remote from the sheet metal members for temporarily melting the metallic wall material, and wherein the connecting steps further includes delivery of any additional metallic material to the first and second walls and temporarily melting the additional metallic material.

15. A method as claimed in claim 11, wherein the connection step includes supplying the heat to the first and second walls using an electric arc or flame.

16. A method as claimed in claim 11, wherein the sheet metal members producing step includes producing the corrugated sheet metal members having corrugations with a height of the corrugations, measured between the opposite corrugation summits, being not more than 1 mm, and a number of corrugations such that, upon formation of each packet, at least 150 passages per 1 $cm^2$ are formed in a cross-section taken perpendicular to the corrugations.

17. A method as claimed in claim 11, wherein the sleeve wall connecting step includes connecting the walls by welding at edges thereof.

18. A method of producing a catalyst body for catalytic treatment of exhaust gas from an internal combustion engine and comprising at least two sleeves each containing a packet of coated sheet metal members, the method comprises the steps of:

producing the at least two sleeves each having a substantially quadrilateral cross-section defined by substantially parallel, spaced from each other, first and second walls and third and fourth walls, with the first and second walls having substantially flat and smooth inner surfaces facing one another;

producing flat sheet metal members and corrugated sheet metal members, with each of the flat and the corrugated sheet metal members having a shape of a parallelogram and opposite straight first and second edges spaced from each other by at most 50 mm in plan view, with corrugations of each of the corrugated sheet metal members being provided along an entire length thereof, extending parallel to the first and second edges of respective corrugated sheets, and having a height measured between opposite corrugations summits of no more than 1 mm and a number of corrugations such that at least 150 passages per 1 $cm^2$ are formed in a cross-section taken perpendicular to a longitudinal extent of the corrugations, with each of the flat and corrugated sheet metal members having a metallic core with two opposite surfaces and a core thickness of at most 0.1 mm and smaller than a thickness of the sleeve walls and with each of the two opposite surfaces being completely covered with a high-surface coating consisting of a porous non-metallic material, at least one oxide, and at least one noble metal serving as a catalytically active material;

forming, in each of the at least two sleeves, the packet of the coated sheet metal members by arranging alternatively the flat and corrugated sheet metal members so that the first and second edges of the sheet metal members face respective inner surfaces of the first and second walls of the at least one sleeve, that the flat sheet metal members contact summits of corrugations of respective corrugated sheet metal members, and that the inner surfaces of the first and second walls continuously extend over the first and second edges, respectively, of all of the flat and corrugated sheet metal members;

connecting the sheet metal members to the first and second walls of each of the at least two sleeves by applying heat to at least two spaced from each other strip-like regions of each of the first and second walls extending along all of the edges facing respective walls to connect at least two edge regions of the first and second edges of the sheet metal members to the first and second walls; and connecting at least one wall of one of the at least two sleeves with an adjacent wall of another of the at least two sleeves to form the catalyst body.

19. A method as claimed in claim 18, wherein the sheet metal members are rectangular.

20. A method as claimed in claim 18, wherein the connecting step includes applying an electric arc to the side of the first and second walls remote from the sheet metal members for temporarily melting the metallic wall material, and wherein the connecting steps further includes delivery of an additional metallic material to the first and second walls and temporarily melting the additional metallic material.

21. A method as claimed in claim 18, wherein the step of connecting of at least one wall of one of the at least two sleeves with an adjacent wall of another of the at least two sleeves includes connecting the walls by welding at edges thereof.

22. A method as claimed in claim 18, wherein the connecting step includes applying flame to the side of the first and second walls remote from the sheet metal members for temporarily melting the metallic wall material, and wherein the connecting steps further includes delivery of an additional metallic material to the first and second walls and temporairly melting the additional metallic material.

23. A catalyst body for catalytic treatment of exhaust gas from an internal combustion engine, comprising:

at least one sleeve having a substantially quadrilateral cross-section defined by substantially parallel, spaced from each other, first and second walls and third and fourth walls, the first and second walls having substantially flat and smooth inner surfaces facing one another; and a packet formed of coated flat and corrugated sheet metal members and arranged in the at least one sleeve;

wherein each of the flat and corrugated sheet metal members has a shape of a parallelogram and opposite straight first and second edges spaced from each other by at most 50 mm in plan view;

wherein corrugations of each of the corrugated sheet metal members are provided along an entire length thereof and extend parallel to the first and second edges of respective corrugated sheets;

wherein each of the flat and corrugated sheet metal members has a metallic core with two opposite surfaces and a core thickness of at most 0.1 mm and smaller than a thickness of the walls of the at least one-sleeve, with each of the two opposite surfaces being completely covered with a coating containing a catalytically active material;

wherein the coated flat and corrugated sheet metal members are arranged alternatively so that the first and second edges of the sheet metal members face respective inner surfaces of the first and second walls of the at least one sleeve, that the flat sheet metal members contact summits of corrugations of respective corrugated sheet metal members, and that the inner surfaces of the first and the second walls continuously extend over the first and second edges, respectively, of all of the flat and corrugated sheet metal members; and wherein each of the sheet metal members is connected to the first and second walls of the at least one sleeve at at least one edge region of each of the first and second edges of the sheet metal members, respectively, by a bond formed as a result of flow of a temporarily melted metallic wall material between coated edge regions of essentially all of the adjacent sheet metal members and caused by application of heat to respective sides of the first and second walls remote from the sheet metal members.

24. A catalyst body as claimed in claims 23, wherein the sheet metal members are rectangular, and wherein the first and second straight edges face the inner surfaces of the walls over an entire length of the first and second edges.

25. A catalyst body as claimed in claim 23, wherein the corrugations of the corrugated sheet metal members have a wavelength of not more than 1 mm, and wherein the packet has at least 150 passages per 1 $cm^2$ in a cross-section taken perpendicular to the corrugations.

26. A catalyst body for catalytic treatment of exhaust gas from an internal combustion engine, comprising:

at least two sleeves each having a substantially quadrilateral cross-section defined by substantially parallel, spaced from each other, first and second walls and third and fourth walls, the first and second walls having substantially flat and smooth inner surfaces facing one another; and a packet formed of coated flat and corrugated sheet metal members and arranged in each of the at least two sleeves;

wherein each of the flat and corrugated sheet metal members has a shape of a parallelogram and opposite straight first and second edges spaced from each other by at most 50 mm in plan view;

wherein corrugations of each of the corrugated sheet metal members are provided along an entire length thereof and extend parallel to the first and second edges of respective corrugated sheets;

wherein each of the flat and corrugated sheet metal members has a metallic core with two opposite surfaces and a core thickness of at most 0.1 mm and smaller than a thickness of the walls of the at least two sleeves, with each of the two opposite surfaces being completely covered with a coating containing a catalytically active material;

wherein the coated flat and corrugated sheet metal members are arranged alternatively so that the first and second edges of the sheet metal members face respective inner surfaces of the first and second walls of each of the at least two sleeves, that the flat sheet metal members contact summits of corrugations of respective corrugated sheet metal members, and that the inner surfaces of the first and the second walls continuously extend over the first and second edges, respectively, of all of the flat and corrugated sheet metal members;

wherein each of the sheet metal members is connected to the first and second walls of each the at least two sleeves at at least one edge region of each of the first and second edges of the sheet metal members, respectively, by a bond formed as a result of flow of a temporarily melted metallic wall material between coated edge regions of essentially all of the adjacent sheet metal members and caused by application of heat to respective sides of the first and second walls remote from the sheet metal members;

wherein at least one wall of each of the at least two sleeves is connected with an adjacent wall of another of the at least two sleeves.

27. A catalyst body as claimed in claim 26, wherein the corrugations of the corrugated sheet metal members have a wavelength of not more than 1 mm, and wherein the packet has at least 150 passages per 1 $cm^2$ in a cross-section taken perpendicular to the corrugations.

28. A catalyst body as claimed in claim 26, wherein the sheet metal members are rectangular, and wherein the first and second straight edges of the sheet metal members face the respective walls over an entire length of the first and second edges.

29. A catalyst body for catalytic treatment of exhaust gas from an internal combustion engine, comprising:

at least two sleeves each having a substantially quadrilateral cross-section defined by substantially parallel, spaced from each other, first and second walls and third and fourth walls, the first and second walls having substantially flat and smooth inner surfaces facing one another; and a packet formed of coated flat and corrugated sheet metal members and arranged in the at least one sleeve;

wherein each of the flat and corrugated sheet metal members has a shape of a parallelogram and opposite straight first and second edges spaced from each other by at most 50 mm in plan view;

wherein corrugations of each of the corrugated sheet metal members are provided along an entire length thereof, extend parallel to the first and second edges of a respective corrugated sheet, and have a height measured between opposite corrugations summits of no more than 1 mm and a number of corrugations such that at least 150 passages per 1 $cm^2$ a formed in a cross-section taken perpendicular to a longitudinal extent of the corrugations;

wherein each of the flat and corrugated sheet metal members has a metallic core with two opposite surfaces and a core thickness of at most 0.1 mm and smaller than a thickness of the walls of the sleeves, with each of the two opposite surfaces being completely covered with a high-surface coating consisting of a porous non-metallic material, at least one oxide, and at least one noble metal serving as a catalytically active material;

wherein the coated flat and corrugated sheet metal members are arranged in the packet alternatively so that the first and second edges of the sheet metal members face respective inner surfaces of the first and second walls of the at least one sleeve, that the flat sheet metal members contact summits of corrugations of respective corrugated sheet metal members, and that the inner surfaces of the first and the second walls continuously extend over the first and second edges, respectively, of all of the flat and corrugated sheet metal members;

wherein each of the sheet metal members is connected to the first and second walls of each the at least two sleeves by bonds formed as a result of application of heat to two, spaced from each other, strip-like regions of each of the first and second walls extending over all of the sheet metal edges facing the first and second walls, respectively, with at at least two edge regions of the first and second edges of the sheet metal members being connected to the first and second walls, respectively; and wherein at least one wall of one of the two sleeves is connected to an adjacent wall of another one of the two sleeves.

30. A catalyst body as claimed in claim 29, wherein the sheet metal members are rectangular, and wherein the first and second straight edges of the sheet metal members face the respective walls over an entire length of the first and second edges.

* * * * *